US011034479B2

(12) United States Patent
Pick

(10) Patent No.: US 11,034,479 B2
(45) Date of Patent: Jun. 15, 2021

(54) PLASTIC CONTAINER

(71) Applicant: BITO-Lagertechnik Bittmann GmbH, Meisenheim (DE)

(72) Inventor: Rolf Pick, Hattgenstein (DE)

(73) Assignee: BITO-LAGERTECHNIK BITTMANN GMBH, Hattgenstein (DE)

( * ) Notice: Subject to any disclaimer, the term of this patent is extended or adjusted under 35 U.S.C. 154(b) by 616 days.

(21) Appl. No.: 15/833,320

(22) Filed: Dec. 6, 2017

(65) Prior Publication Data

US 2018/0162583 A1 Jun. 14, 2018

(30) Foreign Application Priority Data

Dec. 12, 2016 (DE) ..... 10 2016 124 041.9

(51) Int. Cl.
*B65D 1/22* (2006.01)
*B65D 1/42* (2006.01)

(52) U.S. Cl.
CPC ..... *B65D 1/22* (2013.01); *B65D 1/42* (2013.01); *B65D 2501/24019* (2013.01);
(Continued)

(58) Field of Classification Search
CPC ... B65D 1/42; B65D 1/44; B65D 1/46; B65D 1/48; B65D 2501/24783;
(Continued)

(56) References Cited

U.S. PATENT DOCUMENTS 504,480 A * 9/1893 Schifferly ..... 220/628
4,256,224 A * 3/1981 Hirota ..... B65D 1/243 206/203

(Continued)

FOREIGN PATENT DOCUMENTS

DE 19844014 C1 1/2000
DE 29908668 U1 8/2000

(Continued)

OTHER PUBLICATIONS

Extended European Search Report issued in corresponding European Patent Application No. 17197907.3 dated Mar. 21, 2018.

*Primary Examiner* — Anthony D Stashick
*Assistant Examiner* — Raven Collins
(74) *Attorney, Agent, or Firm* — Harness, Dickey & Pierce, P.L.C.

(57) ABSTRACT

The invention relates to a plastic container with a base and side walls standing on the base, wherein a receiving region of the container is defined by the base and the side walls, wherein the base, on its side facing away from the receiving region, forms a plane, wherein the plane carries an inner region, a bearing rim surrounding the inner region, and first ribs protruding from the plane, wherein the bearing rim has a bearing face for the container and the bearing face is elevated in the direction perpendicular to the plane compared to the inner region, wherein each of the first ribs extends in the direction of the bearing rim starting from the inner region, wherein, with respect to each of the first ribs, the end face of the first rib pointing in the direction of extent leads tangentially into the plane.

10 Claims, 4 Drawing Sheets

(52) U.S. Cl.
CPC ..... *B65D 2501/2484* (2013.01); *B65D 2501/24152* (2013.01); *B65D 2501/24541* (2013.01); *B65D 2501/24783* (2013.01); *B65D 2501/24808* (2013.01); *B65D 2501/24853* (2013.01)

(58) Field of Classification Search
CPC .. B65D 2501/24184; B65D 2501/2501; B65D 2501/24146; B65D 2501/0018
USPC ..... 220/660, 628
See application file for complete search history.

(56) References Cited

U.S. PATENT DOCUMENTS

| | | | | |
|---|---|---|---|---|
| 6,401,960 | B1 * | 6/2002 | Hammett | B65D 1/243 206/203 |
| 2002/0195454 | A1 * | 12/2002 | Schafer | B65D 1/42 220/628 |
| 2008/0251991 | A1 * | 10/2008 | Doyo | B65H 5/062 271/109 |

FOREIGN PATENT DOCUMENTS

| | | | |
|---|---|---|---|
| FR | 1320916 | A | 3/1963 |
| GB | 943947 | | 12/1963 |

* cited by examiner

PLASTIC CONTAINER

RELATED APPLICATION DATA

The present application claims priority pursuant to 35 U.S.C. § 119(a) to German Patent Application Number 10 2016 124 041.9 filed Dec. 12, 2016 which is hereby incorporated by reference in its entirety.

FIELD

The invention relates to a plastic container with bearing rim.

BACKGROUND

Various plastic containers with bearing rim are known from the prior art. A plastic container of this kind is described for example in DE 10 2013 207 943 B4.

DE 203 15 302 U1 discloses a container made of plastic, in particular a storage and transport crate, which is produced in one piece by welding and which is provided on the underside of its base with ribs, which form a base centre area, and which has flat surrounds peripherally along the base edge providing an outer bearing rim, as a second base, characterised in that the flat surrounds are formed as smooth frame plates (9) and are welded to a peripheral outer rib (10) and a peripheral inner rib (11) of the base (2).

DE 198 44 014 C1 discloses a transport crate produced in one piece from plastic, with a base that is flat in the middle region of the crate, below which there are disposed at least two parallel runners in the edge region of the box, which runners are connected to the base by ribs running transverse to the runners, wherein outwardly and/or inwardly open pockets are formed by the runners, the transverse ribs and the base underside, and wherein the runners have, on the side facing the centre of the crate, a longitudinally directed portion, which is directed upwardly.

DE 199 17 114 A1 discloses a crate-like container or the like made of plastic and having a data memory, in particular a storage and transport crate, with a base which is stabilised on its underside with reinforcement ribs, which in the region of the base edge carry a bearing rim formed by flat surrounds, which, together with the base and in each case two mutually spaced-apart reinforcement ribs extending transversely to the base edge, defines free spaces which are formed as pockets which are open on the base edge side or bearing rim inner side or as passages which are open on both sides.

SUMMARY

The object of the invention is to improve this plastic container. The object underlying the invention is achieved by the features of the independent claim. Preferred embodiments of the invention are specified in the dependent claims.

What is described is a plastic container with a base and side walls standing on the base, wherein a receiving region of the container is defined by the base and the side walls. The base forms a plane on its side facing way from the receiving region, wherein the plane carries an inner region, a bearing rim surrounding the inner region, and first ribs protruding from the plane. The bearing rim has a bearing face for the container and the bearing face is elevated compared to the inner region in the direction perpendicular to the plane. Each of the first ribs extends starting from the inner region in the direction of the bearing rim, wherein, with respect to each of the first ribs, the end face of the first rib pointing in the direction of extent leads tangentially into the plane.

Within the scope of the present description, a "bearing face" is understood to be the face of the container on which the container stands at least in part on a supporting surface. It preferably stands exclusively with the bearing face on a supporting surface. When rolled on a roller conveyor, the bearing face is the face by means of which the plastic container runs over the rollers of the roller conveyor and then comes into contact with the transport rollers of the roller conveyor. Due to the elevation of the bearing face, the contact area with which the container is in contact with the rollers of the roller conveyor is minimised, whereby the generation of noise as the plastic container slides over the rollers of the roller conveyor can be minimised.

Embodiments of the invention could have the advantage that the load-bearing capability of the plastic container for goods to be transported in its receiving region is increased in that the first specially shaped ribs are now additionally provided. Due to the fact that the first ribs lead tangentially into the plane, forces acting on the plane by means of the goods to be transported are received by the rib without force peaks, whereby the base of the plastic container is stabilised on the whole.

It should be noted that the expression "leads tangentially into a plane" is understood generally to mean that, at the point of contact between the end face and the plane, the gradient of the end face deviates by at most 10° (preferably <5°) from the gradient of the plane at this point. If it is thus assumed that the plane runs in the horizontal, the end face thus leads into the plane at an angle <10°, preferably <5°.

In accordance with one embodiment of the invention, the end face has a concave arc shape. This means that the surface of the end face is curved inwardly, i.e. in a direction against the direction of extent. On account of the concave arc shape, the forces acting on the rib could also be received particularly uniformly, so that here as well the risk of the presence of force peaks in the rib and thus any risk of breakage of the rib is minimised.

For example, the end face overlaps the plane at least in part.

In accordance with one embodiment the plastic container also comprises an inner rim surrounding the inner region, wherein the inner rim is directly adjacent to the bearing rim and the bearing face is elevated in the direction perpendicular to the plane compared to the outer surface of the inner rim facing away from the receiving region. Here, the end face leads tangentially into the inner surface of the inner rim facing towards the receiving region. Due to the presence of the inner rim, this can also receive and distribute the forces acting on the base, wherein, with respect to the plane of the inner rim, the same principles of force distribution are provided on account of the particular shaping of the end face of the first rib. The forces acting on the base are received by the first rib in a manner free from force peaks and are then transferred inter alia to the inner rim, again free from force peaks.

The bearing face is preferably rounded in the direction for receiving the container on its sides facing towards the inside and/or outwardly towards the walls, whereby the bearing face is prevented from running in an abrupt manner over a transport roller, and instead runs over a transport roller steadily, uniformly and gently.

In accordance with one embodiment of the invention the plastic container also comprises second ribs supported by and protruding from the plane, wherein the second ribs carry the bearing rim, the second ribs extend starting from the inner region in the direction of the bearing rim, and the first ribs are received between the second ribs.

Besides the bearing rim, the second ribs can also carry the above-described inner rim and an outer rim, which likewise also forms part of the subject matter of the description.

In particular when the first ribs carry exclusively the inner rim and are thus too short to come into contact with the bearing rim or the outer rim, this could result in the advantage of a weight saving for the plastic container. The first ribs are in this case primarily responsible for the dissipation of forces which act from the receiving region from above the inner region and possibly also from above the inner rim by means of the goods to be transported resting on the base. All other forces, in particular those that act from the receiving region from above the bearing rim, can be transferred directly from the second ribs to the bearing rim and from there to the surface on which the bearing rim stands, for example the transport rollers.

In accordance with a further embodiment of the invention the inner region has a crowning in the direction of the receiving region. The provision of a crowning could have the advantage that a bending of the base above the inner region in the event of high loading of the base by the goods to be transported is possible within specific limits, and it is nevertheless ensured that the container still stands exclusively on the bearing rim on its bearing face. As a result of the crowning, the container base can thus bend a little downwardly in the direction of the inner region without the inner region coming into contact with the surface on which the plastic container is standing by means of its bearing face.

In accordance with an embodiment of the invention the inner region has third ribs, wherein the third ribs protrude from and are carried by the plane, and wherein the surfaces of the third ribs pointing away from the receiving region have the crowning.

In accordance with an embodiment of the invention the plastic container also comprises an outer rim surrounding the bearing face, wherein the outer rim is directly adjacent to the bearing rim and the bearing face is elevated in the direction perpendicular to the plane compared to the outer surface of the outer rim facing away from the receiving region. As already mentioned, this could have the advantage that the container can run gently on the bearing rim on account of the protrusion of the bearing rim between the inner and the outer rim, so that, in particular when the plastic container is rolled over a roller conveyor, the corresponding generation of noise is minimised. The transition between the inner rim and bearing rim or outer rim and bearing rim should preferably not be abrupt, but instead uniformly continuous, so that it is ensured that the bearing rim runs gently over the rollers.

In accordance with an embodiment of the invention all first ribs are connected to one another on their side opposite the end face by means of a continuous wall protruding from and carried by the plane, wherein the wall delimits the interior region. This could have the advantage that, even with a very uneven loading of the container base by the goods to be transported, a high rigidity of the base is ensured, and the resultant forces, which act on a limited region of the base in particular with one-sided loading of the base, are distributed over a plurality of the first ribs. For the same reason, the second and third ribs could also preferably be arranged on the wall in an integrally bonded manner.

In accordance with an embodiment of the invention the wall carries the inner rim. This could also contribute to a positive distribution of forces.

In accordance with a further embodiment of the invention the wall is inclined in a manner pointing away outwardly from the inner region. This means that the wall is inclined pointing away outwardly from the inner region from the base points of the wall, at which the wall leads into the plane. This could in turn have the advantage that, in particular in the inner region, forces acting on account of a central loading of the base of the container are efficiently conducted purposefully in the direction of the bearing rim with avoidance of force peaks. This could contribute on the whole to the stabilisation of the container and could therefore improve the load-bearing capability of the container with heavy goods to be transported.

It goes without saying that the above-described embodiments can be combined arbitrarily with one another, provided the combinations are not mutually exclusive.

BRIEF DESCRIPTION OF THE DRAWINGS

Embodiments of the invention will be explained in greater detail hereinafter with reference to the drawings, in which.

Elements similar to one another will be denoted hereinafter by like reference signs.

DETAILED DESCRIPTION

Figure 1:
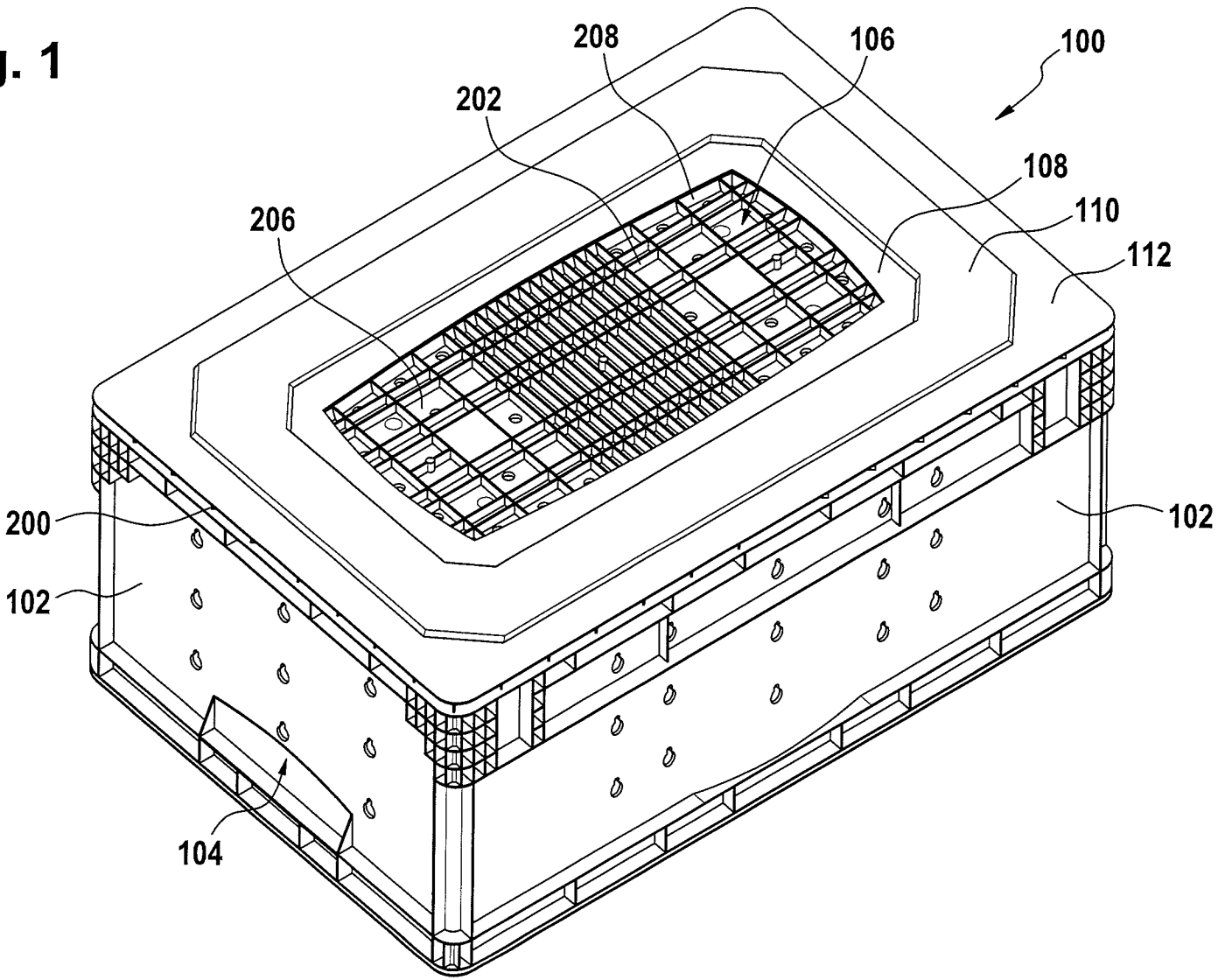
FIG. 1 shows a perspective view of a plastic container from below.

FIG. 1 shows a plastic container 100 with a base and side walls 102 standing on the base. A receiving region 104 of the container is defined by the base and the side walls 102, in which receiving region goods to be transported can be received. On the side of the base facing away from the receiving region 104, the container 100 has an inner region 106, which is provided with ribs. An inner rim 108 surrounds the inner region 106, and a bearing rim 110 surrounds the inner rim 108. Lastly, a further, outer rim 112 is also provided, which surrounds the bearing rim 110.

The bearing rim 110 is slightly elevated compared to the inner rim 108 and the outer rim 112. In addition, the bearing rim is elevated compared to the inner region 106, so that, as the container runs over a transport surface, for example over transport rollers or over balls, the container 100 comes into contact with the transport surface or the transport rollers (balls) exclusively via the bearing face of the bearing rim 110. Various ribs are provided in order to provide the container 100 as a whole with the necessary rigidity, although it stands or slides on the bearing face merely by means of the bearing face of the bearing rim 110.

Figure 2:
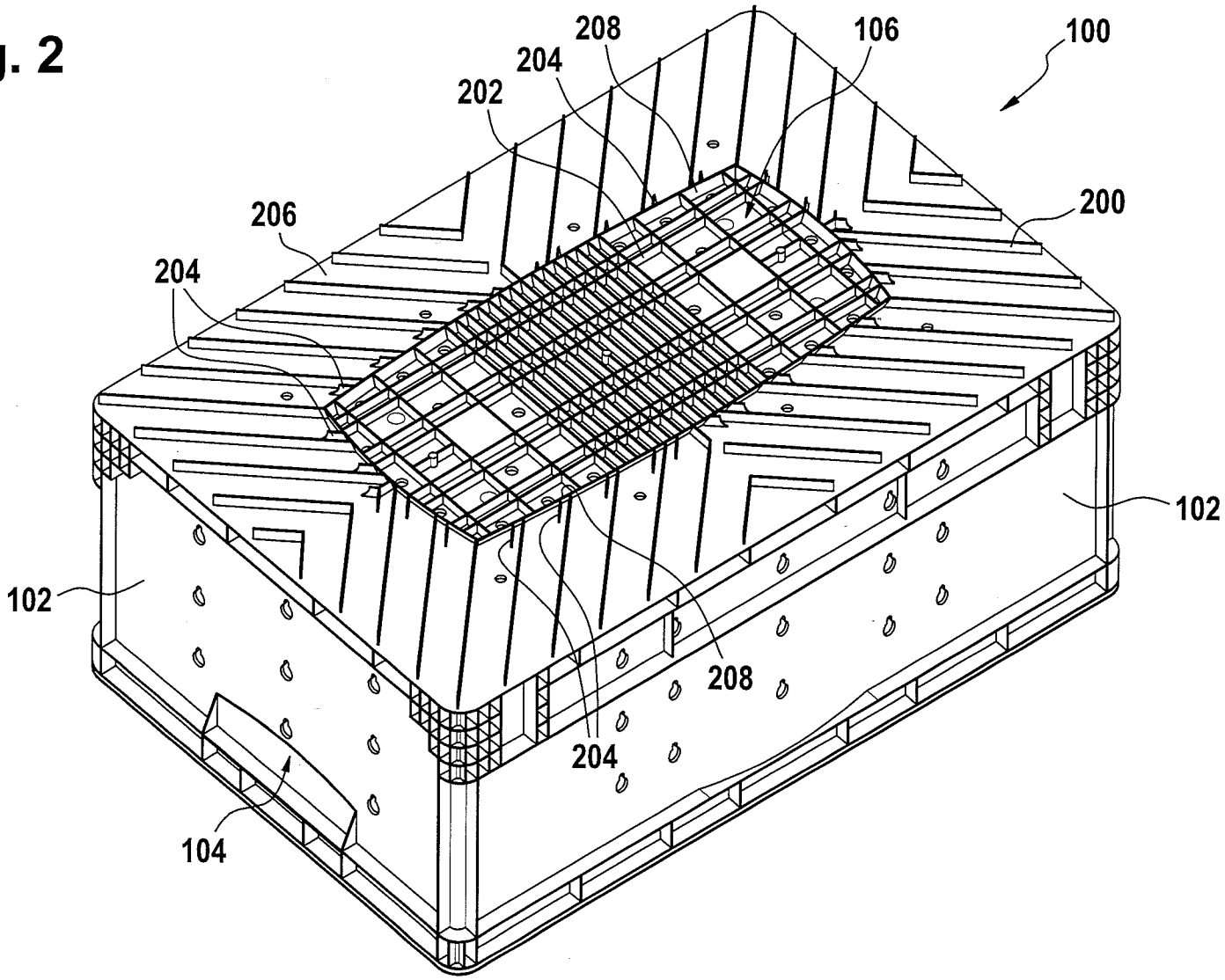
FIG. 2 shows a further view of the container of FIG. 1, wherein here the inner, outer and bearing rim have been removed.

FIG. 2 is a further perspective view of the container shown in FIG. 1, wherein here, for the sake of simplicity, the inner rim 108, the bearing rim 110, and the outer rim 112 have been omitted from the drawing. As a result, besides ribs 202 of the inner region 106, further ribs 204 and further ribs 200 are now also visible (incompletely as viewed in the direction perpendicular to the plane 206). The base of the container 100 forms a plane 206 on its side facing away from the receiving region 104, which plane carries all visible ribs.

The inner region 106 or ribs 202 thereof are enclosed by means of a continuous wall 208, wherein the ribs 204 are adjacent to this wall 208 and are connected to the wall 208 in an integrally bonded manner. The plastic container 100 is preferably produced in one piece from a single material, for example by means of a corresponding injection-moulding process.

The ribs 200, which stand on the plane 206 and are carried by this plane 206, in turn carry both the bearing face 110 and the outer bearing rim 112. By contrast, the much shorter ribs 204 arranged between the ribs 200 carry merely the inner rim 108, wherein the inner rim 108 is also carried additionally by the ribs 200.

Figure 3:
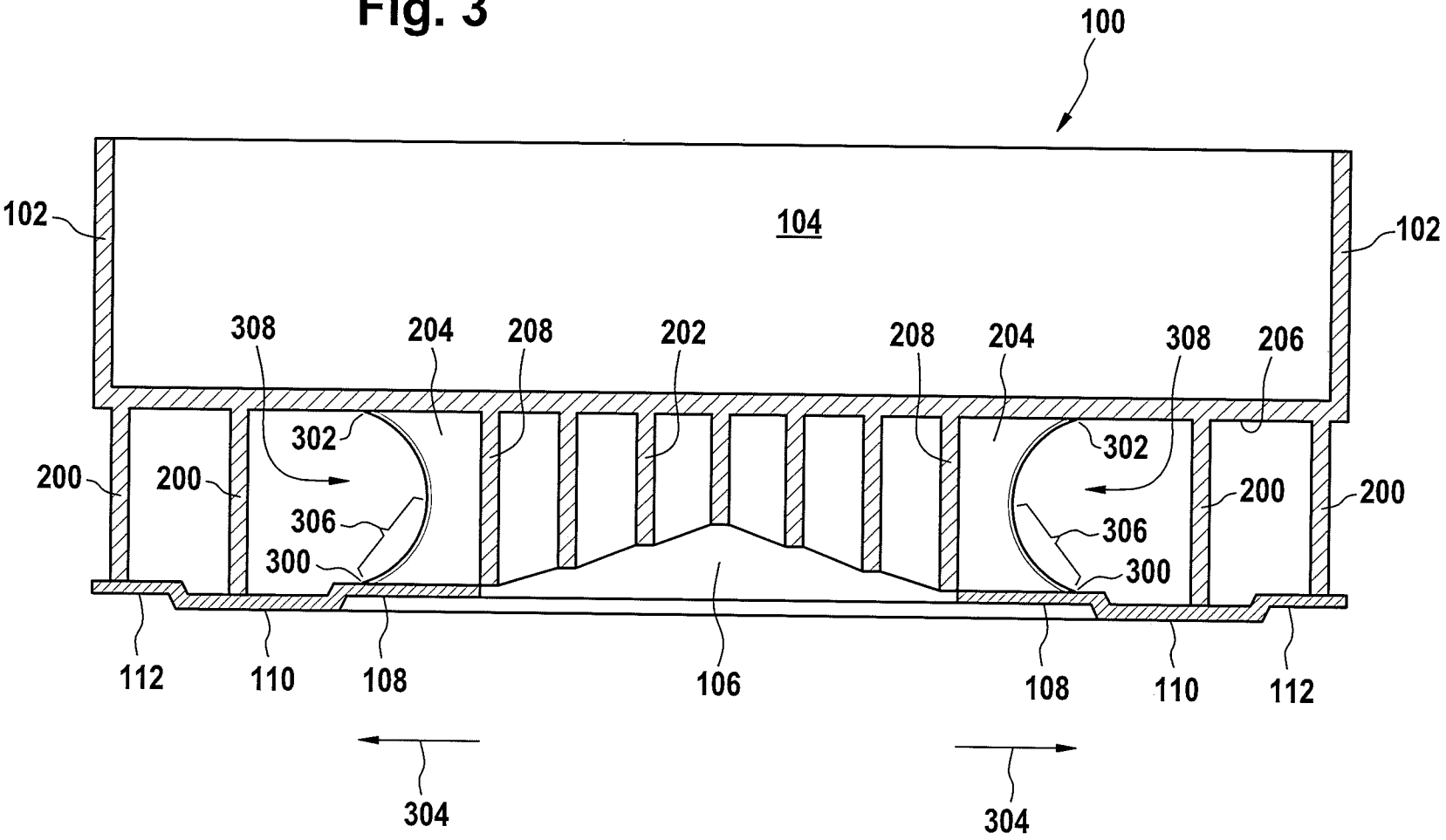
FIG. 3 shows a schematic cross-sectional view through a container.

FIG. 3 shows a schematic cross-sectional view through the container 100, wherein here it is assumed, for the sake of simplicity, that the ribs each run at right angles to the walls 102.

In FIG. 3 the receiving region 104 of the container 100 is now visible together with the base of said container, which receiving region is delimited by the base and the side walls 102. The base, on its side facing away from the receiving region, forms the plane 206, which in the inner region 106 carries the ribs 202 and in the region to the side of the inner region 106 carries the ribs 204 and 200.

The ribs 202 of the inner region 106 have what is known as a crowning, which means that there is a curvature in the direction of the receiving region, so that the container base in the inner region 106 can deflect downwardly under heavy loads, but without the ribs coming into contact with the surface on which the container 100 is standing.

The inner region 106 is surrounded by the wall 208, wherein, in the example of FIG. 3, the wall 208 is not inclined, but stands perpendicular to the plane, again for the sake of simplicity. It is possible, however, that the wall 208 is inclined outwardly, that is to say in the direction 304 starting from the base point to the wall between the plane 206 and wall 208. Corresponding forces acting on the plane 206 are conducted here efficiently from the inner region 106 in the direction of the bearing face 110.

The ribs 204 each extend in the direction 304, that is to say in the direction of the bearing rim 110 starting from the inner region 106. Here, the end faces 308 of the ribs 204 lead both tangentially into the plane 206 at the points 302 and (optionally) into the inner side of the inner rim 108 at the points 300. On account of this "gentle" transition of the end faces 308 of the ribs 204 into the plane 206 and the inner rim 108, force peaks are avoided at the transition points 300 and 302, so that any risk of breakage at these points with heavy loads received in the receiving region 104 can be minimised.

The ribs 204 additionally have a concave shape, so that the end faces 308 of the ribs partially overlap the plane 206. The region of overlap is sketched by way of example in FIG. 3 by reference sign 306.

In the example of FIG. 3, the end faces of the ribs 204 thus have a C shape.

The ribs 200 transfer the forces acting on the plane 206 to the bearing rim 110. On the whole, the geometry shown in FIG. 3 could make it possible for the container 100 to be able to slide with little noise on the bearing face 110, for example over a roller conveyor, even with a presence of great loads in the receiving region 104.

Figure 4:
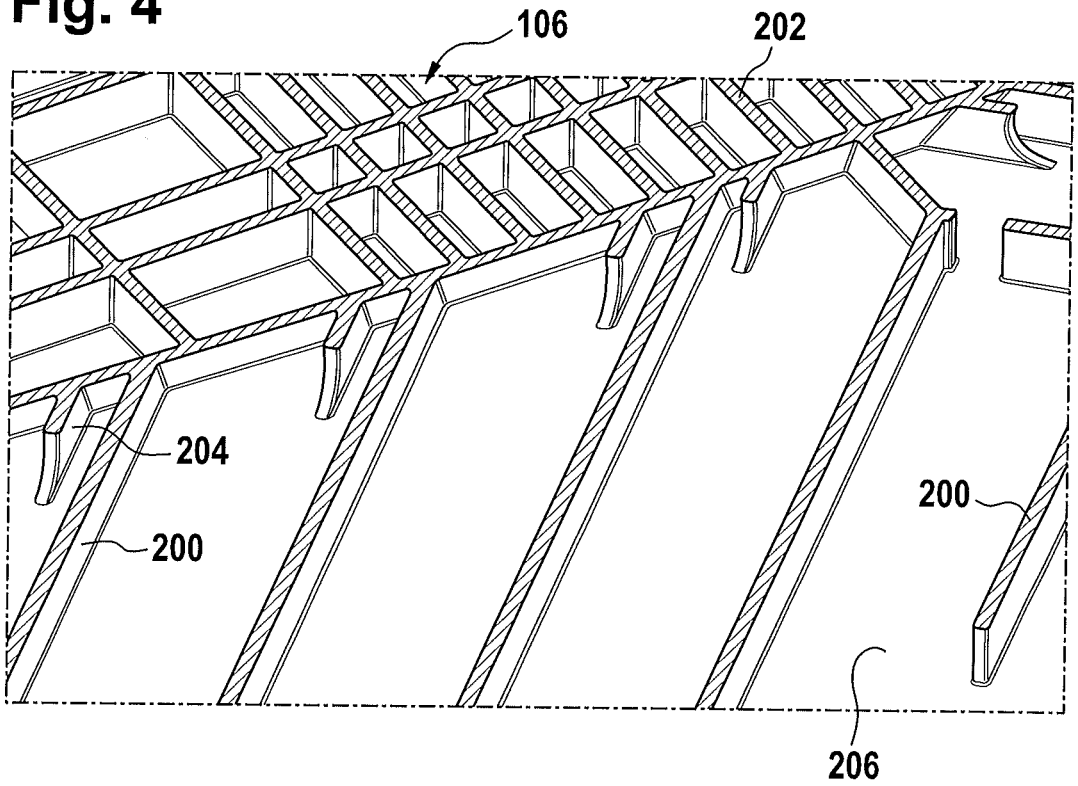
FIG. 4 shows a perspective view of the inner region with the adjacent first and second ribs.
Figure 5:
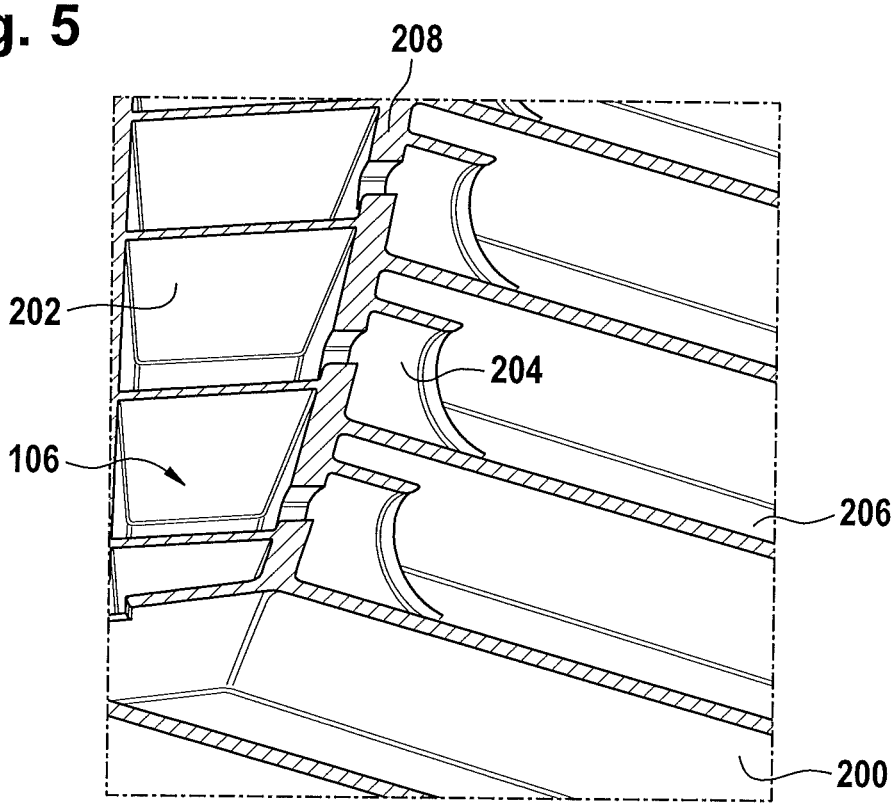
FIG. 5 shows a more detailed perspective view of the inner region with the adjacent first and second ribs.

FIG. 4 shows a perspective view of the container of FIG. 1, wherein here as well the bearing rim, the inner rim and the outer rim have again been removed. The same is true in respect of the detailed view of FIG. 5. The parts of the ribs directly adjacent to the inner rim, the bearing rim and the outer rim are likewise omitted here. It should be noted that in the drawing the tangential transition of the ribs 204 at the point 300 (see FIG. 3) is not clearly visible at this point. However, the geometrical shape of the ribs 204 behaves in a mirror-image-like manner with respect to the geometrical shape of the ribs 204 at the point 302, which in particular is clearly visible in FIG. 4.

LIST OF REFERENCE SIGNS

100 container
102 side wall
104 receiving region
106 inner region
108 inner rim
110 bearing rim
112 outer rim
200 rib
202 rib
204 rib
206 plane
208 wall
300 integration point
302 transition point
304 direction
306 region

The invention claimed is:

1. A plastic container comprising a base and side walls standing on the base, wherein a receiving region of the container is defined by the base and the side walls, wherein the base, on its side facing away from the receiving region, forms a plane, wherein the plane carries an inner region, a bearing rim surrounding the inner region, and first ribs protruding from the plane, wherein the bearing rim has a bearing face for the container and the bearing face is elevated in the direction perpendicular to the plane compared to the inner region, wherein each of the first ribs extends in the direction of the bearing rim starting from the inner region, wherein, with respect to each of the first ribs, an end face of the first rib pointing in the direction of extent leads tangentially into the plane, wherein the end face partially overlaps the plane in an overlapping region, the overlapping region lying between the inner region and the bearing rim.

2. The plastic container according to claim 1, wherein the end face has a concave arc shape.

3. The plastic container according to claim 1 further comprising an inner rim surrounding the inner region, wherein the inner rim is directly adjacent to the bearing rim, wherein the bearing face is elevated in the direction perpendicular to the plane compared to the outer surface of the inner rim facing away from the receiving region, wherein the end face leads tangentially into the inner surface of the inner rim facing the receiving region.

4. The plastic container according to claim 1 further comprising second ribs protruding from and carried by the plane, wherein the second ribs carry the bearing rim, the second ribs extend in the direction of the bearing rim starting from the inner region, and the first ribs are received between the second ribs.

5. The plastic container according to claim 1, wherein the inner region has a crowning in the direction of the receiving region.

6. The plastic container according to claim 5, wherein the inner region comprises third ribs, wherein the third ribs protrude from and are carried by the plane, and wherein the surfaces of the third ribs pointing away from the receiving region have the crowning.

7. The plastic container according to claim 1 further comprising an outer rim surrounding the bearing face, wherein the outer rim is directly adjacent to the bearing rim and the bearing face is elevated in the direction perpendicular to the plane compared to the outer surface of the outer rim facing away from the receiving region.

8. The plastic container according to claim 1, wherein all first ribs are interconnected on their side opposite the end face by means of a continuous wall protruding from and carried by the plane, wherein the wall delimits the inner region.

9. The plastic container according to claim 8, wherein the wall carries the inner rim.

10. The plastic container according to claim 8, wherein the wall is inclined pointing away outwardly from the inner region.

* * * * *